US008461097B2

(12) United States Patent
Demeyere

(10) Patent No.: US 8,461,097 B2
(45) Date of Patent: Jun. 11, 2013

(54) FABRIC SOFTENER

(75) Inventor: Hugo Jean Marie Demeyere, Merchtem (BE)

(73) Assignee: The Procter & Gamble Company, Cincinnati, OH (US)

( * ) Notice: Subject to any disclaimer, the term of this patent is extended or adjusted under 35 U.S.C. 154(b) by 222 days.

(21) Appl. No.: 13/078,056

(22) Filed: Apr. 1, 2011

(65) Prior Publication Data

US 2011/0245140 A1 Oct. 6, 2011

Related U.S. Application Data

(60) Provisional application No. 61/319,914, filed on Apr. 1, 2010.

(51) Int. Cl.
*C11D 1/835* (2006.01)

(52) U.S. Cl.
USPC ..... 510/527; 510/522

(58) Field of Classification Search
USPC ..... 510/522, 527
See application file for complete search history.

(56) References Cited

U.S. PATENT DOCUMENTS

| | | | | |
|---|---|---|---|---|
| 4,234,627 | A | 11/1980 | Schilling | |
| 4,514,461 | A | 4/1985 | Woo | |
| RE32,713 | E | 7/1988 | Woo | |
| 4,882,220 | A | 11/1989 | Ono et al. | |
| 4,917,920 | A | 4/1990 | Ono et al. | |
| 5,137,646 | A | 8/1992 | Schmidt et al. | |
| 6,200,949 | B1 | 3/2001 | Reijmer et al. | |
| 6,492,322 | B1 | 12/2002 | Cooper et al. | |
| 6,645,479 | B1 | 11/2003 | Shefer et al. | |
| 6,653,275 | B1 * | 11/2003 | Fender et al. | 510/527 |
| 2003/0060390 | A1 | 3/2003 | Demeyere et al. | |
| 2003/0126282 | A1 | 7/2003 | Sarkar et al. | |
| 2003/0158344 | A1 | 8/2003 | Rodriques et al. | |
| 2003/0165692 | A1 | 9/2003 | Koch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216488 | A1 | 11/2003 | Uchiyama et al. | |
| 2003/0220210 | A1 | 11/2003 | DuVal et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0204337 | A1 | 10/2004 | Corona et al. | |
| 2005/0075267 | A1 * | 4/2005 | DuVal et al. | 510/522 |
| 2006/0094639 | A1 | 5/2006 | Martin et al. | |
| 2007/0219111 | A1 | 9/2007 | Ward et al. | |
| 2008/0242584 | A1 * | 10/2008 | Wahl et al. | 510/517 |
| 2011/0110993 | A1 | 5/2011 | Chieffi et al. | |

FOREIGN PATENT DOCUMENTS

| | | | |
|---|---|---|---|
| EP | 1 393 706 | A1 | 3/2004 |
| WO | WO 2007/026314 | A2 | 3/2007 |

OTHER PUBLICATIONS

International Search Report; International Application No. PCT/US2011/030672; date of mailing Jul. 12, 2011; 3 pages.

* cited by examiner

*Primary Examiner* — John Hardee
(74) *Attorney, Agent, or Firm* — James F. McBride; Steven W. Miller

(57) ABSTRACT

Methods of making a fabric softener composition comprising 1% to 49% of the bis-(2-hydroxyethyl)-dimethylammonium chloride fatty acid ester by weight of the composition are provided.

22 Claims, No Drawings

FABRIC SOFTENER

CROSS-REFERENCES TO RELATED APPLICATIONS

This application claims priority to and benefit of U.S. Provisional Patent Application No. 61/319,914, filed on Apr. 1, 2010.

FIELD OF THE INVENTION

The present invention is directed to methods of making a fabric softener.

BACKGROUND OF THE INVENTION

There is a need for a fabric softener product made from fabric softener active composition having a low content of flammable solvents, a low melt viscosity and high stability in a molten state.

Quaternary ammonium salts carrying two hydrophobic long chain hydrocarbon moieties have found broad use as fabric softener actives. Quaternary ammonium salts of alkanolamines esterified with on average two fatty acid moieties per molecule, commonly referred to as ester quats, have largely replaced earlier alkyl quaternary ammonium compounds because of their biodegradability.

Bis-(2-hydroxyethyl)-dimethylammonium chloride fatty acid diesters, which have found commercial use, are difficult to handle in a pure state, since the solid tends to lump and the melt has high viscosity at low melt temperatures and unsatisfactory stability at higher melt temperatures. Therefore, bis-(2-hydroxyethyl)-dimethylammonium chloride fatty acid diesters are usually shipped as a molten composition containing at least 13% by weight of ethanol or 2-propanol, which has a viscosity at temperatures of 65 to 75° C. that is sufficiently low for pumping. However, such compositions have a low flash point of less than 30° C. and are therefore subject to regulatory restrictions and require additional safety measures in handling. WO 2007/026314 proposes to replace the flammable solvent of such compositions by 2 to 40% by weight of a diluent chosen from alkyl esters or polyesters, alkyl amides or polyamides, fatty acids, nonionics or combinations thereof and specifically discloses hydrogenated tallow fat, hydrogenated tallow fatty acid, hydrogenated coconut oil, hydrogenated palm stearine, hydrogenated soy oil, ethylene glycol distearate hard soy sucrose ester, cetyl palmitate and pentaerythritol tetracaprylate/tetracaprate as suitable diluents. WO 2007/026314 further proposes to use an additional coupling agent, selected from polyhydric alcohols, partial esters of polyhydric alcohols non-ionic surfactants, in an amount from 0.1 to 15% by weight. However, the compositions taught by WO 2007/026314 have the disadvantage of a low stability in the molten state with respect to dealkylation of the quaternary ammonium salt, which leads to an increase in the content of free ester amine during transport and handling in a molten state. Therefore, there is still a need for fabric softener active compositions which have a low melt viscosity and high stability in a molten state and at the same time have a low flammability.

SUMMARY OF THE INVENTION

The present invention attempts to solve these and other needs by providing a method of making a fabric softener composition having from 1% to 49% of the bis-(2-hydroxyethyl)-dimethylammonium chloride fatty acid ester by weight of the fabric softener composition comprising the step of mixing water with a fabric softener active composition (FSAC), wherein the FSAC comprises: (i) from 65 to 95% by weight of the FSAC of a bis-(2-hydroxyethyl)-dimethylammonium chloride fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50; (ii) from 2 to 8% by weight of the FSAC of a fatty acid triglyceride having an average chain length of the fatty acid moieties from 10 to 14 carbon atoms and an iodine value, calculated for the free fatty acid, from 0 to 15; and (iii) from 3 to 12% by weight of an alcohol of the FSAC selected from ethanol, 1-propanol and 2-propanol; to form the fabric softener composition having from 1% to 49% of the bis-(2-hydroxyethyl)-dimethylammonium chloride fatty acid ester by weight of the fabric softener composition.

DETAILED DESCRIPTION OF THE INVENTION

It has now been found that fabric softener compositions made from fabric softener active compositions based on a bis-(2-hydroxyethyl)-dimethylammonium chloride fatty acid ester made from fatty acids with a specific chain length and a specific degree of unsaturation and having a particular molar ratio of fatty acid moieties to amine moieties, which comprise a specific amount of a fatty acid triglyceride, having a specific lower chain length of the fatty acid moieties, as well as a specific amount of an alcohol, selected from ethanol, 1-propanol and 2-propanol, show an unexpected combination of low melt viscosity, high stability towards dealkylation in the molten state and low flammability.

The present invention is therefore directed to methods of fabric softener composition comprising 1% to 49% of a bis-(2-hydroxyethyl)-dimethylammonium chloride fatty acid ester by weight of the fabric softener composition, comprising the steps of mixing water with a fabric softener active composition (FSAC), wherein the FSAC comprises:

a) from 65 to 95% by weight of the bis-(2-hydroxyethyl)-dimethylammonium chloride fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50,
b) from 2 to 8% by weight of a fatty acid triglyceride having an average chain length of the fatty acid moieties from 10 to 14 carbon atoms and an iodine value, calculated for the free fatty acid, from 0 to 15, and
c) from 3 to 12% by weight of an alcohol selected from ethanol, 1-propanol and 2-propanol.

In one embodiment, the method further comprises adding perfume to make the fabric softener composition.

The invention is further directed to a method for making such fabric softener compositions, further comprising the steps:

a) reacting a mixture comprising from 78 to 95% by weight bis-(2-hydroxyethyl)-methylamine fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50, from 2 to 9% by weight of a fatty acid triglyceride having an average chain length of the fatty acid moieties from 10 to 14 carbon atoms and an iodine value, calculated for the free fatty acid, from 0 to 15, and from 3 to 12% by weight of an alcohol selected from ethanol, 1-propanol and 2-propanol with an excess of methyl chloride at a temperature from 60 to 120° C. to provide a reaction mixture, and b) separating unreacted methyl chloride from the reaction mixture of step a) by distilling off a mixture of methyl chloride and said alcohol, condensing alcohol from said mixture of methyl chloride and alcohol and returning condensed alcohol to said reaction mixture to provide a content of alcohol from 3 to 12% by weight.

The invention is also directed to an alternative method for making such fabric softener compositions, further comprising the steps:

a) reacting a mixture comprising from 88 to 98% by weight bis-(2-hydroxyethyl)-methylamine fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50, from 2 to 9% by weight of a fatty acid triglyceride having an average chain length of the fatty acid moieties from 10 to 14 carbon atoms and an iodine value, calculated for the free fatty acid, from 0 to 15, and from 0 to 3% by weight of an alcohol selected from ethanol, 1-propanol and 2-propanol with an excess of methyl chloride at a temperature from 60 to 120° C. to provide a reaction mixture, b) adding more of the alcohol to the reaction mixture of step a) to provide a content of alcohol from 3 to 12% by weight, and c) separating unreacted methyl chloride from the mixture of step b) by distilling off a mixture of methyl chloride and said alcohol, condensing alcohol from said mixture of methyl chloride and alcohol and returning condensed alcohol to said reaction mixture to provide a content of alcohol from 3 to 12% by weight.

The fabric softener active composition, used in the methods of making fabric softener compositions, comprises from 65 to 95% by weight of bis-(2-hydroxyethyl)-dimethylammonium chloride fatty acid ester. The fabric softener active composition preferably comprises from 80 to 90% by weight of said ester. The fabric softener composition comprises from 1% to 49% of said ester.

The bis-(2-hydroxyethyl)-dimethylammonium chloride fatty acid ester comprises at least one diester of formula $(CH_3)_2N^+(CH_2CH_2OC(=O)R)_2Cl^-$ and at least one monoester of formula $(CH_3)_2N^+(CH_2CH_2OH)(CH_2CH_2C(=O)R)\ Cl^-$, where R is the hydrocarbon group of a fatty acid moiety RCOO. The bis-(2-hydroxyethyl)-dimethylammonium chloride fatty acid ester has a molar ratio of fatty acid moieties to amine moieties from 1.80 to 1.96 and preferably from 1.85 to 1.94. The specified molar ratio provides high softening performance in a rinse cycle fabric softener.

The fatty acid moiety of the bis-(2-hydroxyethyl)-dimethylammonium chloride fatty acid ester can be derived from a pure fatty acid or a mixture of fatty acids of formula RCOOH, where R is a hydrocarbon group. The hydrocarbon group may be branched or unbranched and preferably is unbranched.

The fatty acid moiety has an average chain length from 16 to 18 carbon atoms and an iodine value, calculated for the free fatty acid, from 0 to 50, alternatively from 18 to 22. The average chain length is preferably from 16.5 to 17.8 carbon atoms. Preferably, the fatty acid moiety has an iodine value from 1.0 to 50, more preferably from 2 to 50, even more preferably from 5 to 40 and most preferably from 15 to 35. The average chain length is calculated on the basis of the weight fraction of individual fatty acids in the mixture of fatty acids. For branched chain fatty acids the chain length refers to the longest consecutive chain of carbon atoms. The iodine value is the amount of iodine in g consumed by the reaction of the double bonds of 100 g of fatty acid, determined by the method of ISO 3961. In order to provide the required average chain length and iodine value, the fatty acid moiety can be derived from a mixture of fatty acids comprising both saturated and unsaturated fatty acids. The unsaturated fatty acids are preferably monounsaturated fatty acids. The bis-(2-hydroxyethyl)-dimethylammonium chloride fatty acid ester preferably comprises less than 6% by weight of multiple unsaturated fatty acid moieties. Examples of suitable saturated fatty acids are palmitic acid and stearic acid. Examples of suitable monounsaturated fatty acids are oleic acid and elaidic acid. The cis-trans-ratio of double bonds of unsaturated fatty acid moieties is preferably higher than 55:45 and more preferably higher than 65:35. In one embodiment, the cis-trans-ratio is from 1.33 to 3.11, respectively. The fraction of multiple unsaturated fatty acid moieties may be reduced by selective touch hydrogenation, which is a hydrogenation that selectively hydrogenates one double bond in a —CH═CH—$CH_2$—CH═CH-substructure but not double bonds of monounsaturated hydrocarbon groups. The specified average chain length and iodine values are essential for simultaneously achieving high softening performance and low melting point of the composition. If the average chain length is less than 16 carbon atoms or the iodine value is higher than 50, the softening performance will be unsatisfactory, whereas the melting point of the composition can get too high if the average chain length is more than 18 carbon atoms.

The fatty acid moiety may be derived from fatty acids of natural or synthetic origin and is preferably derived from fatty acids of natural origin, most preferably from tallow fatty acid. The required iodine value can be provided by using a fatty acid mixture of natural origin that already has such an iodine value, for example a tallow fatty acid. Alternatively, the required iodine value can be provided by partial hydrogenation of a fatty acid mixture or a triglyceride mixture having a higher iodine value. In a further and preferred embodiment, the required iodine value is provided by mixing a fatty acid mixture having a higher iodine value with a mixture of saturated fatty acids. The mixture of saturated fatty acids may be obtained either by hydrogenating a fatty acid mixture containing unsaturated fatty acids or from a hydrogenated triglyceride mixture, such as a hydrogenated vegetable oil.

The fabric softener active composition used in the methods of making fabric softener composition of the present invention further comprises from 2 to 8% by weight and preferably from 3 to 6% by weight of a fatty acid triglyceride having an average chain length of the fatty acid moieties from 10 to 14 carbon atoms and an iodine value, calculated for the free fatty acid, from 0 to 15. The average chain length of the fatty acid moieties is preferably from 12 to 13.8 carbon atoms. The fatty acid triglyceride is preferably a coconut oil or a hydrogenated coconut oil and most preferably a refined coconut oil. The specified amount of fatty acid triglyceride and average chain length of the fatty acid moieties is important for simultaneously achieving low melting point and low flammability of the fabric softener active composition. Surprisingly, the specified amount of fatty acid triglyceride also improves the softening efficiency of a rinse cycle softener prepared from the fabric softener active composition of the present invention.

The fabric softener active composition used in the methods of the present invention also comprises from 3 to 12% by weight and preferably from 6 to 10% by weight of an alcohol selected from ethanol, 1-propanol and 2-propanol. The alcohol is preferably ethanol or 2-propanol and most preferably 2-propanol. The specified amount of alcohol is important for simultaneously achieving low flammability of the fabric softener active composition and high stability of the composition in the molten state towards dealkylation of the bis-(2-hydroxyethyl)-dimethylammonium chloride fatty acid ester. The improvement in stability that can be achieved by the specified amount of alcohol appears to be specific for the chloride salt. The combined amount of fatty acid triglyceride and the alcohol is preferably from 10 to 15% by weight.

The fabric softener active compositions used in the methods of the present invention show a combination of high stability towards dealkylation in the molten state, low melt viscosity and low flammability. A fabric softener active composition comprising 86% by weight bis-(2-hydroxyethyl)-dimethylammonium chloride tallow fatty acid ester, 3% by weight coconut oil and 9% by weight 2-propanol has a flash point of 38° C. determined according to DIN 53213. The fabric softener active composition of the present invention can be prepared by mixing bis-(2-hydroxyethyl)-dimethylammonium chloride fatty acid ester, fatty acid triglyceride and alcohol in the specified amounts. However, the fabric softener active composition is preferably prepared by one of the two methods of the invention, which share the quaternisation of a bis-(2-hydroxyethyl)-methylamine fatty acid ester with excess methyl chloride in the presence of the fatty acid triglyceride and the subsequent separation of excess methyl chloride in the presence of the alcohol.

The first method of the invention comprises two steps. In the first step, a mixture comprising from 78 to 95% by weight bis-(2-hydroxyethyl)-methylamine fatty acid ester, from 2 to 9% by weight of a fatty acid triglyceride and from 3 to 13% by weight of an alcohol selected from ethanol, 1-propanol and 2-propanol are reacted with an excess of methyl chloride at a temperature from 60 to 120° C. and preferably from 90 to 110° C. The molar amount of methyl chloride is larger than the molar amount of bis-(2-hydroxyethyl)-methylamine fatty acid ester and the molar ratio of methyl chloride to bis-(2-hydroxyethyl)-methylamine fatty acid ester is preferably from 1.1 to 1.5. The bis-(2-hydroxyethyl)-methylamine fatty acid ester has a molar ratio of fatty acid moieties to amine moieties from 1.80 to 1.96, preferably from 1.82 to 1.92, an average chain length of the fatty acid moieties from 16 to 18 carbon atoms, preferably from 16.5 to 17.8 carbon atoms, and an iodine value, calculated for the free fatty acid, from 0 to 50, preferably from 1.0 to 50, more preferably from 2 to 50, even more preferably from 5 to 40 and most preferably from 15 to 35. The fatty acid triglyceride has an average chain length of the fatty acid moieties from 10 to 14 carbon atoms, preferably from 12 to 13.8 carbon atoms, and an iodine value, calculated for the free fatty acid, from 0 to 15 and is preferably a coconut oil or a hydrogenated coconut oil. The reaction is preferably carried out in a pressure vessel at a total pressure from 1 to 10 bar, preferably 3 to 8 bar. The methyl chloride is preferably added to the mixture of bis-(2-hydroxyethyl)-methylamine fatty acid ester, fatty acid triglyceride and alcohol at a rate that avoids an increase of pressure beyond the specified upper limit. The reaction is preferably carried out until more than 80%, preferably more than 85% of the bis-(2-hydroxyethyl)-methylamine fatty acid ester has reacted. Suitable reaction times are in the range from 2 to 8 h depending on the reaction temperature and pressure.

In the second step, unreacted methyl chloride is separated from the reaction mixture of step a) by distilling off a mixture of methyl chloride and the alcohol, condensing alcohol from the mixture of methyl chloride and alcohol that distils off and returning condensed alcohol to the reaction mixture to provide a content of alcohol from 3 to 12% by weight in the reaction mixture. The mixture of methyl chloride and alcohol is preferably distilled off at a total pressure from 0.2 to 1 bar. The alcohol is preferably condensed from the mixture of methyl chloride and alcohol in a partial condenser at a temperature between the boiling points of methyl chloride and the alcohol at the pressure employed for the distillation. All or a part of the condensed alcohol may be returned to the reaction mixture, depending on the content of alcohol that is desired for the resulting mixture.

The second method of the invention comprises three steps and differs from the first method of the invention in that in the first step the initial mixture comprises from 88 to 98% by weight bis-(2-hydroxyethyl)-methylamine fatty acid ester and from 0 to 3% by weight of the alcohol and in that in an additional step more of the alcohol is added to the reaction mixture of the first step to provide a content of alcohol from 3 to 12% by weight, before the step of separating unreacted methyl chloride from the mixture is carried out.

The two methods of the invention have the advantage of providing a fabric softener active composition having a low content of non-quaternized bis-(2-hydroxyethyl)-methylamine fatty acid ester at short reaction times. The second method of the invention has the additional advantage of low by-product formation from alkylation of the alcohol and a further reduced alkylation reaction time.

Making Fabric Softener Compositions

Fabric softener compositions typically have 1% to 49%, alternatively from 2% to 25%, alternatively from 3% to 20%, alternatively from 5% to 17%, alternatively combinations thereof, of the bis-(2-hydroxyethyl)-dimethylammonium chloride fatty acid ester by weight of the composition.

One aspect of the invention provides fabric softening composition comprising cationic polymers for aiding in depositions and/or rheology benefits. See e.g., U.S. Pat. No. 6,492,322 B1; US 2006-0094639. In one embodiment, the composition comprises from 0.1% to 5%, preferably from 0.7% to 2.5%, by weight of a cationic cross-linked polymer that is desirable from the polymerization from 5 to 100 mole present of cationic vinyl addition monomer, from 0 to 95 mole percent of acrylamide and from 50 to 1000 parts per million (ppm), preferably 350 to 100 ppm, more preferably 500 to 1000 ppm of a vinyl addition monomer cross-linking agent. An example of such polymer may include Rheovis CDE from Ciba (BASF).

Adjunct Ingredients

Adjunct ingredients that may be added to the compositions of the present invention. The ingredients may include: suds suppressor, preferably a silicone suds suppressor (US 2003/0060390 A1, ¶65-77), cationic starches (US 2004/0204337 A1; US 2007/0219111 A1); scum dispersants (US 2003/0126282 A1, ¶89-90); perfume and perfume microcapsules (U.S. Pat. No. 5,137,646); nonionic surfactant, non-aqueous solvent, fatty acid, dye, preservatives, optical brighteners, antifoam agents, and combinations thereof.

Other adjunct ingredients may include: dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, antimicrobial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, enzymes, cationic starch, and combinations thereof. In one embodiment, the composition comprises one or more adjunct ingredient up to 2% by weight of the composition. In yet another embodiment, the composition of the present invention may be free or essentially free of any one or more adjunct ingredients. In yet another embodiment, the composition is free or essentially free of detersive laundry surfactants.

In one embodiment, the pH of the composition may comprise a pH from 2 to 5, preferably from 2 to 4.5, and more preferably from 2.5 to 4.

In one embodiment, the composition of the present invention further comprises a perfume microcapsule. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627. In another embodiment, the perfume microcapsule comprises a friable microcapsule (e.g., aminoplast copolymer comprising perfume microcapsule, esp. melamine-formaldehyde or urea-formaldehyde). In another embodiment, the perfume microcapsule comprises a moisture-activated microcapsule (e.g., cyclodextrin comprising perfume microcapsule). In another embodiment, the perfume microcapsule may be coated with a polymer (alternatively a charged polymer). See e.g., US published patent application claiming priority to U.S. Provisional Application Ser. No. 61/258,900, filed Nov. 6, 2009

In one aspect of the invention, a method of softening or treating a fabric is provided. In one embodiment, the method comprises the step of administering a composition of the present invention to a rinse cycle of an automatic laundry machine or a hand washing laundry rinse basin. The term "administering" means causing the composition to be delivered to a laundry rinse bath solution. Examples of administering include, for example, dispensing the composition in an automatic fabric softener dispenser that is integral to the laundry washing machine whereby the dispenser dispenses the composition at the appropriate time during the laundry washing process, e.g., last rinse cycle. Another example is dispensing the composition in a device, such a DOWNY BALL, wherein the device will dispense the composition at the appropriate time during the laundry washing process. In another embodiment, a composition of the present invention is dosed in a first rinse bath solution or a dosed in a single rinse bath solution. This is particularly convenient in a hand washing context. See e.g., U.S. Pat. Appl. No. 2003-0060390 A1. In one embodiment, a method of softening a fabric in a manual rinse processes comprising the steps: (a) adding a fabric softening composition of the present invention to a first rinse bath solution; (b) rinsing manually the fabric in the first rinse bath solution; (c) optionally the fabric softening composition comprises a suds suppressor. A method of reducing the volume of water consumed in a manual rinse process comprises the aforementioned step is also provided.

The invention is illustrated by the following examples, which are however not intended to limit the scope of the invention in any way.

EXAMPLES

Fabric softener active compositions were prepared from coconut oil, 2-propanol and a bis-(2-hydroxyethyl)-dimethylammonium chloride tallow fatty acid ester with an iodine value of 20, calculated for the free fatty acid, having a molar ratio of fatty acid moieties to amine moieties of 1.89 and containing 0.044 mmol/g bis-(2-hydroxyethyl)-methylamine fatty acid ester, 0.041 mmol/g bis-(2-hydroxyethyl)-methylammonium chloride fatty acid ester and 0.111 mmol/g fatty acid by mixing the powdered quaternary ammonium salt with the solvents in the amounts given in table 1 and melting the mixtures.

Storage stability was determined for fabric softener active compositions that were stored for 5 days at 100° C. in closed glass bottles.

Melt viscosities were measured at 90° C. with a StressTech rheometer of REOLOGICA® instruments using 50 mm parallel plates, a plate distance of 1 mm and shear rates of 1, 10 and 100 $s^{-1}$.

TABLE 1

Properties of fabric softener active compositions

| | Example | | |
|---|---|---|---|
| | 1* | 2* | 3 |
| Fraction quat:coconut oil:2-propanol in % by weight | 92:0:8 | 96:4:0 | 88:4:8 |
| Melt viscosity at 1 $s^{-1}$ in mPa * s | 272 | 13200 | 262 |
| Melt viscosity at 10 $s^{-1}$ in mPa * s | 237 | 9010 | 236 |
| Melt viscosity at 100 $s^{-1}$ in mPa * s | 219 | 2290 | 194 |
| Fraction of quat dealkylated after 5 d storage at 100° C. in % | 7.8 | 10.0 | 7.9 |

*Not according to the invention

Examples: The following are non-limiting examples of the fabric softener compositions of the present invention.

| | FORMULATION EXAMPLES | | | | | | | | |
|---|---|---|---|---|---|---|---|---|---|
| (% wt) | I | II | III | IV | V | VI | VII | VIII | IX |
| FSA [a] | 15 | 12.25 | 12.25 | 12.25 | 12.25 | 5 | 5 | 17 | 12.25 |
| Isopropyl Alcohol | 1.53 | 1.25 | 1.25 | — | 1.25 | 0.5 | 0.5 | — | — |
| Ethanol | — | — | — | — | — | — | — | 1.75 | — |
| Coconut Oil | 0.51 | 0.42 | 0.42 | — | | 0.17 | 0.17 | 0.58 | — |
| Starch [b] | — | — | — | — | — | — | — | 0.8 | — |
| Thickening | 0.15 | 0.01 | 0.15 | — | — | 0.01 | 0.01 | — | — |

-continued

| (% wt) | FORMULATION EXAMPLES | | | | | | | | |
|---|---|---|---|---|---|---|---|---|---|
| | I | II | III | IV | V | VI | VII | VIII | IX |
| Agent [c] | | | | | | | | | |
| Perfume | 0.5 | 4.0 | 2.4 | 4.0 | 3.5 | 1.5 | 0.5 | 1.25 | 4.0 |
| Perfume Micro-Capsules [d] | — | — | — | — | 0.25 | — | — | 0.5 | — |
| Calcium Chloride | 0.10 | 0.05 | — | 0.10 | 0.10 | — | — | 0.19 | 0.10 |
| DTPA [e] | 0.05 | 0.05 | 0.05 | 0.05 | 0.05 | 0.05 | 0.05 | 0.008 | 0.05 |
| Preservative (ppm) [f] | 75 | 75 | 75 | 75 | 75 | 75 | 75 | 75 | 75 |
| Antifoam [g] | 0.005 | 0.005 | 0.005 | 0.005 | 0.005 | 0.005 | 0.005 | 0.014 | 0.005 |
| Dye (ppm) | 40 | 65 | 75 | 65 | 65 | 50 | 50 | 30 | 65 |
| HCl | 0.020 | 0.010 | 0.010 | 0.02 | 0.02 | 0.01 | 0.02 | 0.010 | 0.02 |
| Formic Acid | 0.025 | 0.025 | 0.025 | 0.025 | 0.025 | — | — | — | 0.025 |
| Deionized Water | Balance | Balance | Balance | Balance | Balance | Balance | Balance | Balance | Balance |

[a] Fabric Softening Active from Example 3
[b] Cationic high amylose maize starch available from National Starch under the trade name HYLON VII ®.
[c] Rheovis CDE ex Ciba.
[d] Perfume microcapsules available ex Appleton
[e] Diethylenetriaminepentaacetic acid.
[f] Korelone B-119 (1,2-benzisothiazolin-3-one) available from Rohm and Haas. "PPM" is "parts per million."
[g] Silicone antifoam agent available from Dow Corning Corp. under the trade name DC2310 or Silicone MP10.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a fabric softener composition comprising 1% to 49% of the bis-(2-hydroxyethyl)-dimethylammonium chloride fatty acid ester by weight of the fabric softener composition comprising the step of mixing water with a fabric softener active composition (FSAC), wherein the FSAC comprises:

(i) from 65 to 95% by weight of the FSAC of the bis-(2-hydroxyethyl)-dimethylammonium chloride fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50, (ii) from 2 to 8% by weight of the FSAC of a fatty acid triglyceride having an average chain length of the fatty acid moieties from 10 to 14 carbon atoms and an iodine value, calculated for the free fatty acid, from 0 to 15, and (iii) from 3 to 12% by weight of the FSAC of an alcohol selected from ethanol, 1-propanol and 2-propanol;

to form the fabric softener composition having from 1% to 49% of the bis-(2-hydroxyethyl)-dimethylammonium chloride fatty acid ester by weight of the fabric softener composition.

2. The method of claim 1, wherein the FSAC comprising from 3 to 6% by weight of said fatty acid triglyceride and from 6 to 10% by weight of said alcohol.

3. The method of claim 2, wherein the combined amount of said fatty acid triglyceride and said alcohol in the FSAC is from 10 to 15% by weight of the FSAC.

4. The method of claim 3, wherein the fatty acid triglyceride of the FSAC is a coconut oil or a hydrogenated coconut oil.

5. The method of claim 4, wherein the fatty acid moieties of the bis-(2-hydroxyethyl)-dimethylammonium chloride fatty acid ester have an iodine value, calculated for the free fatty acid, from 15 to 35.

6. The method of claim 3, wherein the fatty acid moieties of the bis-(2-hydroxyethyl)-dimethylammonium chloride fatty acid ester have an iodine value, calculated for the free fatty acid, from 15 to 35.

7. The method of claim 2, wherein the fatty acid triglyceride of the FSAC is a coconut oil or a hydrogenated coconut oil.

8. The method of claim 7, wherein the fatty acid moieties of the bis-(2-hydroxyethyl)-dimethylammonium chloride fatty acid ester have an iodine value, calculated for the free fatty acid, from 15 to 35.

9. The method of claim 2, wherein the fatty acid moieties of the bis-(2-hydroxyethyl)-dimethylammonium chloride fatty acid ester have an iodine value, calculated for the free fatty acid, from 15 to 35.

10. The method of claim 1, wherein the combined amount of said fatty acid triglyceride and said alcohol in the FSAC is from 10 to 15% by weight of the FSAC.

11. The method of claim 10, wherein the fatty acid triglyceride of the FSAC is a coconut oil or a hydrogenated coconut oil.

12. The method of claim 11, wherein the fatty acid moieties of the bis-(2-hydroxyethyl)-dimethylammonium chloride fatty acid ester have an iodine value, calculated for the free fatty acid, from 15 to 35.

13. The method of claim 10, wherein the fatty acid moieties of the bis-(2-hydroxyethyl)-dimethylammonium chloride fatty acid ester have an iodine value, calculated for the free fatty acid, from 15 to 35.

14. The method of claim 1, wherein the fatty acid triglyceride of the FSAC is a coconut oil or a hydrogenated coconut oil.

15. The method of claim 14, wherein the fatty acid moieties of the bis-(2-hydroxyethyl)-dimethylammonium chloride fatty acid ester have an iodine value, calculated for the free fatty acid, from 15 to 35.

16. The method of claim 1, wherein the fatty acid moieties of the bis-(2-hydroxyethyl)-dimethylammonium chloride fatty acid ester have an iodine value, calculated for the free fatty acid, from 15 to 35.

17. The method of claim 1, wherein the fatty acid moieties of the bis-(2-hydroxyethyl)-dimethylammonium chloride fatty acid ester have an iodine value, calculated for the free fatty acid, from 18 to 22.

18. The method according to claim 1, further comprising the steps a) reacting a mixture comprising from 78 to 95% by weight bis-(2-hydroxyethyl)-methylamine fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50, from 2 to 9% by weight of a fatty acid triglyceride having an average chain length of the fatty acid moieties from 10 to 14 carbon atoms and an iodine value, calculated for the free fatty acid, from 0 to 15, and from 3 to 13% by weight of an alcohol selected from ethanol, 1-propanol and 2-propanol with an excess of methyl chloride at a temperature from 60 to 120° C. to provide a reaction mixture, and b) separating unreacted methyl chloride from the reaction mixture of step a) by distilling off a mixture of methyl chloride and said alcohol, condensing alcohol from said mixture of methyl chloride and alcohol and returning condensed alcohol to said reaction mixture to provide a content of alcohol from 3 to 12% by weight.

19. The method of claim 18, wherein the mixture of methyl chloride and alcohol is distilled off at a total pressure from 0.2 to 1 bar.

20. The method of claim 1, further comprising the steps a) reacting a mixture comprising from 88 to 98% by weight bis-(2-hydroxyethyl)-methylamine fatty acid ester having a molar ratio of fatty acid moieties to amine moieties from 1.80 to 1.96, an average chain length of the fatty acid moieties from 16 to 18 carbon atoms and an iodine value, calculated for the free fatty acid, from 0 to 50, from 2 to 9% by weight of a fatty acid triglyceride having an average chain length of the fatty acid moieties from 10 to 14 carbon atoms and an iodine value, calculated for the free fatty acid, from 0 to 15, and from 0 to 3% by weight of an alcohol selected from ethanol, 1-propanol and 2-propanol with an excess of methyl chloride at a temperature from 60 to 120° C. to provide a reaction mixture, b) adding more of the alcohol to the reaction mixture of step a) to provide a content of alcohol from 3 to 12% by weight, and c) separating unreacted methyl chloride from the mixture of step b) by distilling off a mixture of methyl chloride and said alcohol, condensing alcohol from said mixture of methyl chloride and alcohol and returning condensed alcohol to said reaction mixture to provide a content of alcohol from 3 to 12% by weight.

21. The method of claim 20, wherein the mixture of methyl chloride and alcohol is distilled off at a total pressure from 0.2 to 1 bar.

22. The method of claim 1, further comprising the step of adding a perfume.

* * * * *